US007610992B2

(12) United States Patent
Brittingham

(10) Patent No.: US 7,610,992 B2
(45) Date of Patent: Nov. 3, 2009

(54) METHOD OF ASSEMBLY FOR SOUND SUPPRESSORS

(76) Inventor: Kevin Tyson Brittingham, 1434 Hillcrest Rd., Norcross, GA (US) 30093

( * ) Notice: Subject to any disclaimer, the term of this patent is extended or adjusted under 35 U.S.C. 154(b) by 0 days.

(21) Appl. No.: 11/998,542

(22) Filed: Dec. 1, 2007

(65) Prior Publication Data

US 2009/0139795 A1 Jun. 4, 2009

(51) Int. Cl.
*F41A 21/30* (2006.01)

(52) U.S. Cl. ..... 181/223; 89/14.3; 89/14.4

(58) Field of Classification Search ..... 181/223; 89/14.3, 14.4
See application file for complete search history.

(56) References Cited

U.S. PATENT DOCUMENTS 3,786,895 A * 1/1974 Perrine ..... 181/223
3,888,331 A * 6/1975 Wang ..... 181/253
4,576,083 A * 3/1986 Seberger, Jr. ..... 89/14.4
4,588,043 A * 5/1986 Finn ..... 181/223
4,643,272 A * 2/1987 Gaffrig ..... 181/260
4,907,488 A * 3/1990 Seberger ..... 89/14.4
5,679,916 A * 10/1997 Weichert ..... 89/14.4
6,374,718 B1 4/2002 Rescigno
6,575,074 B1 6/2003 Gaddini
6,595,099 B1 * 7/2003 Olson et al. ..... 89/14.2
7,073,426 B1 * 7/2006 White ..... 89/14.4

* cited by examiner

*Primary Examiner*—Jeffrey Donels
*Assistant Examiner*—Jeremy Luks
(74) *Attorney, Agent, or Firm*—Greenbaum Doll & McDonald PLLC; Glenn D. Bellamy

(57) ABSTRACT

Provided is a method of assembly for a noise suppressor using specific welding and assembly procedures. By welding the inner portion of a noise suppressor to form a semi complete core an outer tube can then be placed over said core to reinforce the noise suppressor as a whole. The described process allows for an overall reduction of tube wall thickness and provides for a reduction of weight. By affixing each baffle, spacer, end cap and mount together as a whole the strength of the entire unit is multiplied. My method is not restricted to any particular baffle technology but may in fact be incorporated into any design where circumferential fusion welds may be used.

4 Claims, 2 Drawing Sheets

METHOD OF ASSEMBLY FOR SOUND SUPPRESSORS

BACKGROUND OF THE INVENTION

1. Field of Invention

This invention generally relates to a conventional process whereby a sound suppressor constructed from wieldable materials is assembled, and in particular when and inner tube containing baffles, mount and end cap are secured to an outer tube.

2. Prior Art

Previous systems exist for assembling sound suppressors. A number of sound suppressor devices exist which use a tube to contain baffles. Welding is not commonly used to secure the baffles to the tube. The end cap and mount for the sound suppressors are often threadedly secured to the tube which serves as the body for the sound suppressor device. All of these designs lack the strength necessary to meet the standards of the United States Armed Forces.

The standard arm of the US military is the M16/M4 rifle. This firearm uses the NATO standard 5.56 mm cartridge. The 5.56 NATO cartridge can generate 78,000 PSI and raise the temperature of a rifle sound suppressor being fired full automatic to a temperature exceeding 1000 degree Fahrenheit if enough rounds are discharged. A typical way to produce a sound suppressor capable of handling such high heat and pressure is to increase the material thickness of the sound suppressor tube and possibly the baffles.

Increasing material thickness adds weight to the end of a rifle barrel which can have a negative effect on accuracy. Additional weight on the end of a firearm barrel is another down side from the end user perspective who needs to be able to raise and fire the firearm rapidly.

Designs which are assembled with a tube wall thickness which is to thin and are not welded properly will self destruct. Typically this destruction merely renders the sound suppressor useless but in some instances it can cause the sound suppressor to block the aperture through the sound suppressor which a discharged projectile is supposed to pass. The result is poor accuracy at best, but the possibility of rendering the firearm inoperable is present.

Threads which are commonly used as a means of securing a rifle silencer create points of weakness where the individual items are threadedly secured. Circumferential fusion welds eliminate the need to threadedly secure the tube and noise suppressor together.

Other weapons such as the US military M249 SAW will create failure with improperly assembled sound suppressor very rapidly due to the high rate of fire such weapons are designed to provide.

My design provides for a novel process of assemble for a sound suppressor and particularly a sound suppressor intended to be used with a firearm capable of full automatic fire.

A superior means of assembly can be had if the sound suppressor comprises an inner tube which is made up of the front end cap, mount, baffles and spacers all welded together to form the inner core. This inner core is essentially the sound suppressor. An additional outer core is then slid over the inner core and secured by welds to the front end cap and mount. This design allows the outer tube to be half the thickness necessary of other designs because the spacers and baffle when welded as a full assembly provide a solid wall. Effectively the wall of the silencer is layered to help slow down the build up of heat between the two layers of metal and to full take advantage of the strength which the spacers provide to the structure of the sound suppressor. A key element to this assembly process is circumferential welds. Full penetration, circumferential welds are provided on all mating surfaces between the front end cap, each spacer, mount and each baffle. The outer tube is then circumferential welded to the front end cap and mount. The end result is a reduced wall thickness as compared to other designs, and a sound suppressor capably of handling heat and pressure far in excess of its counter parts on the market.

OBJECTS AND ADVANTAGES

Accordingly several objects and advantages of the present invention are (a) To provide a process of assembly where the wall thickness of the tube may be reduced without sacrificing structural strength.

(b) To provide a process of assembly which allows material to be removed from the outer tubes wall thickness thereby reducing the weight of the sound suppressor.

(c) To provide a process of assembly that produces a sound suppressor capable of surviving temperatures exceeding 1000 degrees Fahrenheit.

(d) To provide a process of assembly which ferruminates each baffle, spacer, end cap and mount of the sound suppressor and allows for an outer tube to be slip over the inner assembly and secured.

(e) To provide a process of assembly which does not rely on threads as a method of coupling.

Still further objects and advantages will become apparent from a consideration of the ensuing description and drawings.

SUMMARY

In general terms the present inventions provides a method of assembling a sound suppressor which allows for reducing relative material thickness while increasing the structural strength of the design. The method described will work with any design which utilizes materials that may be welded or ferruminates. The end user of a product which utilizes my described method will have a lighter weight sound suppressor which will be capable of containing higher pressures at higher temperatures while at the same time being lighter than other conventionally assembled sound suppressors.

Specifically my method affords several key advantages over other more conventional methods of assembly. Using circumferential welds to secure about the edge each pieces of the internal silencer core creates a complete assembly. Full penetration welds effectively bind the metal creating a single unit. The internals consist of a mount, end cap and a series of spacers and baffles depending on the preferred configuration of the manufacturer. Once this internal assembly is completed a tube is slid over the out side. This tube is them circumferentially welded about the mount and end cap to secure the tube in place. By assembling the sound suppressor in this manner the wall thickness of material around the blast chamber of the silencer may be cut in half, while the wall thickness around the tertiary chamber may be reduced by 75%. This creates a lighter weight assembly which is as structurally strong as the conventional designs not assembled in this manner.

Material wall thickness may be reduced for several reasons. Fusion welding the baffles, spacers, mounts and end cap into a single assembly eliminates all gaps between each individual part rendering the sum of all parts as a single unit. This single unit assists in containing the pressures generated from the discharging firearm. When the fore mentioned assembly has an outer tube placed about it the combined thickness of the internal assembly and tube will strengthen the unit as a whole. Designs which do not circumferentially fusion weld the internals are loosing the strength of the internal material and are in fact relying almost exclusively on the wall thickness of the tube.

DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

GLOSSARY OF TERMS

Figure 1:
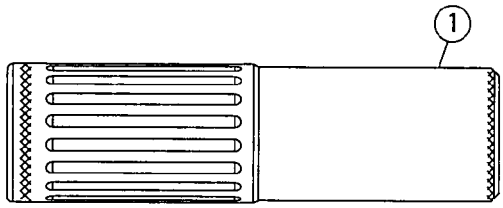
FIG. 1 shows an external side view of a fully welded noise suppressor.

1: Fully welded noise suppressor
2: Baffle core
3: Noise suppressor mount
4: Spacers
5: Baffles
6: Front end cap
7: Spacer/baffle weld
8: Mount/spacer weld
9: Front end cap weld
10: Tube
20: 762SD alternate embodiment noise suppressor tube
21: 762SD Front end cap/spacer weld
22: 762SD Baffle spacer weld
23: 762 Mount/spacer weld
24: 762SD mount
25: 762SD Front end cap
30: SPR alternate embodiment noise suppressor tube
31: SPR front end cap
32: SPR baffle/spacer weld
33: SPR mount/spacer weld
34: SPR mount
35: SPR spacer/front end cap weld

DETAILED DESCRIPTION OF THE PREFERRED EMBODIMENT

As used herein, the word "front" or "forward" corresponds to the firing direction of the noise suppressor (i.e., to the right as shown in FIGS. 1 thru 6); "rear" or "rearward" or "back" corresponds to the direction opposite the firing direction of the noise suppressor (i.e., to the left as shown in FIGS. 1 thru 6);

Turning now to the drawings in which like reference characters indicate corresponding elements throughout the several views, attention is directed to FIG. 1 where a fully welded noise suppressor 1 is depicted. Shown are the external circumferential welds which secure the mount 3, and front end cap 6 to the tube 23.

Figure 2:
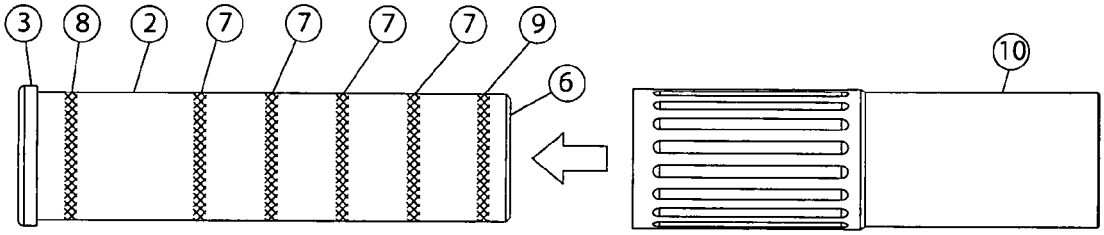
FIG. 2 shows an external view of the welded baffle, spacer and mount core with a tube waiting for installation.
Figure 3:
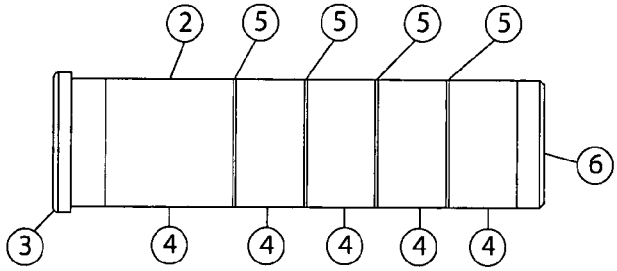
FIG. 3 shows a series of baffles, spacers, end cap and mount assembled prior to being circumferentially welded.

In FIGS. 2 & 3, there is illustrated a view of a welded baffle core 2 and a tube 10. The baffle core 2 is assembled in a specific configuration to optimize sound and to utilize Advanced Armaments various mounting systems. Starting from the back of FIG. 2; are illustrated the noise suppressor mount 3, mount/spacer weld 8, plurality of spacer/baffle weld 7, front end cap weld 9 and the front end cap 6. Forward of the baffle core 2 assembly is located the tube 10. The tube 10 is a hollow cylinder which is design to fit snugly around baffle core 2 and of proper length to cover the entire baffle core 2 except the end cap 6. Mount/spacer weld 8, the series of spacer/baffle weld 7, and the front end cap weld 9 serve to form the mount 3, spacers 4, baffles 5, and end cap 6, depicted in FIG. 3, into a single assembly or baffle core 2. This is superior to other deigns which either spot weld the baffles, spacers, front end cap and mount together or those which rely on threadedly securing a mount and front end cap into a tube.

Figure 4:
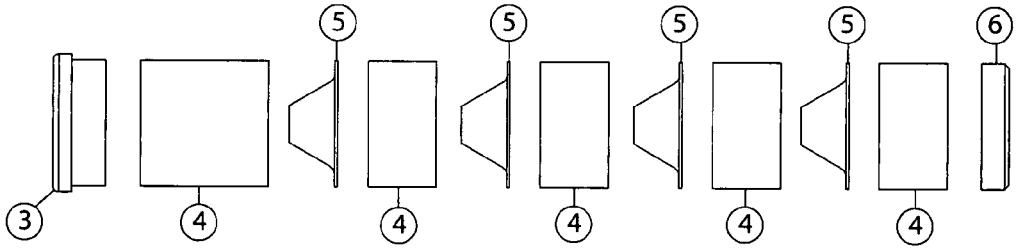
FIG. 4 shows a series of baffles, spacer, end cap and mount in proper orientation prior to assembly and welding.
Figure 5:
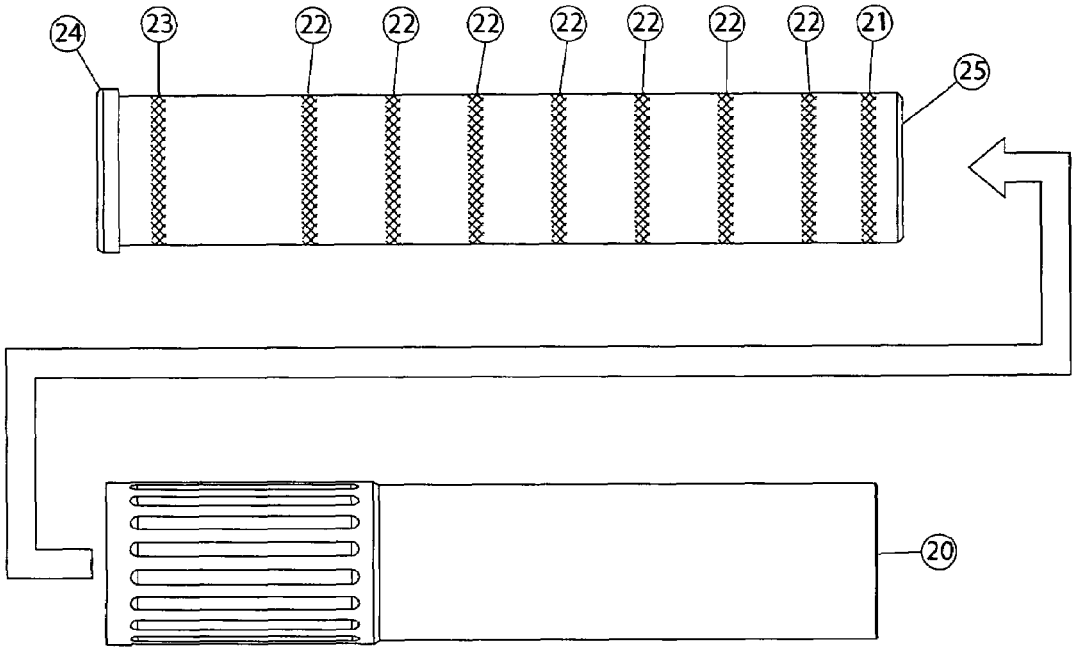
FIG. 5 shows another embodiment of a noise suppressor baffle core welded with a non welded tube.
Figure 6:
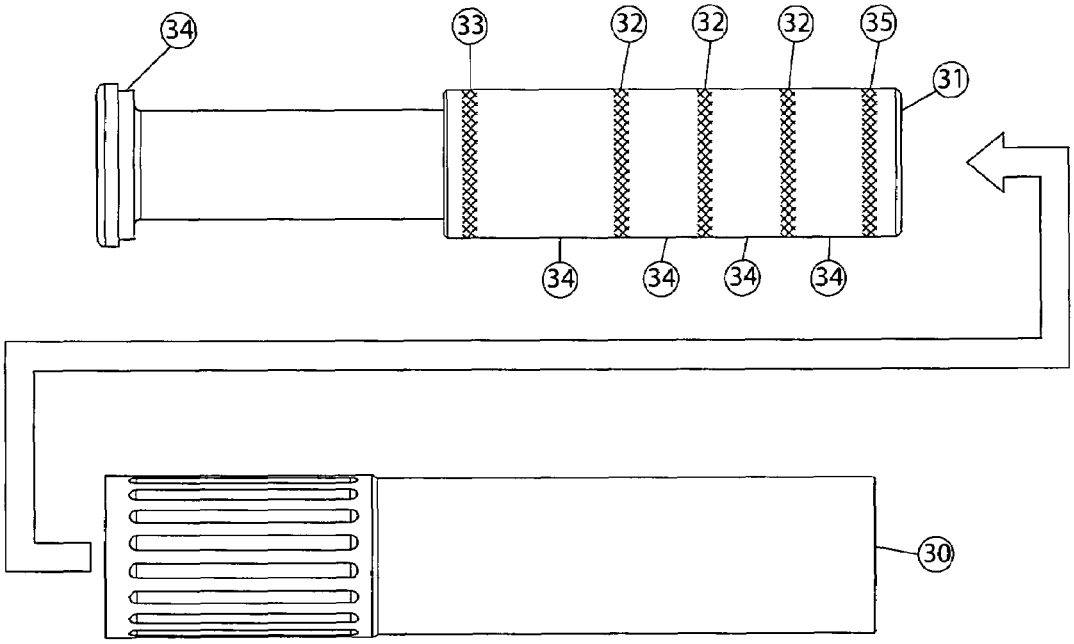
FIG. 6 shows an example of a noise suppressor using a different mounting system, as compared to the preferred embodiment, baffles, spacers and end cap welded with circumferential welds awaiting the installation of a tube.

In FIGS. 3 & 4, there is illustrated a view of the baffle core 2 separated. The mount 3 is designed to secure about a firearm barrel or other device which will secure the noise suppressor to a host firearm. The spacers 4 are a series of cylindrical tubes which are meant to space the various internals of the fully welded noise suppressor 1. The baffles 5 which are illustrated in the preferred embodiment drawing are of the cone variety and serve to create turbulence and thereby increase noise reduction. I will note that my method is not limited to noise suppressors which use cones. The front end cap 6 is placed at the end of the assembly to form a complete contained unit for which to slow the exit of expanding gases from a firearm. A hole is placed in the front end cap 6 to allow for a bullet to pass unobstructed. The baffles 5, spacers 4, front end cap 6, and mount 3 must all have an out side diameter which is similar in order for each of item to be circumferentially welded to one another. The baffles 5, spacers 4, front end cap 6, tube 10 and mount 3 must be machined or stamped from a material which may be welded. As illustrated in FIG. 3 once the baffles 5 and spacers 4 are placed together as an assembly the cone area of the baffle 5 is contained within the spacer 4.

My method is designed to form the inner components of a noise suppressor into a fully welded baffle core 2. Once completed the gaps present between the spacers, mount, front end cap, and baffles are no longer points of weakness. Since the tube 10 is no longer solely responsible for containing the pressures of a discharging firearm the out side diameter of the tube 10 may be reduced. This reduction in diameter reduces the overall weight of the fully welded noise suppressor 1.

Full penetration, circumferential welds are used to bond all connecting surfaces of each spacer 4, mount 3, end cap 6, baffle 5, and tube 10. To achieve the proper weld penetration and to produce an aesthetically pleasing weld a robotic lathe welder is used.

The fully welded baffle core 2 is superior to spot welded baffle cores because the entire mating surface of each internal component of the noise suppressor 1 is fully welded. With each baffle 5, spacer 4, tube 10, and mount 3 circumferentially welded to one another dependency of a limited plurality of strong points is eliminated. Circumferential welds better distribute the burden of restraining the noise suppressors' internal part. Spot welds leave the possibility of one weld failing and causing the internals of the noise suppressor to collapse. This scenario is less likely to happen with full penetration, circumferential welds.

The tube 10 has an inside diameter of sufficient size as to contain the assembled and welded baffle core 2. Full penetration, circumferential welds are used to secure the tube 10 to the baffle core 10 about the front where the front end cap 6 protrudes from the tube 10 and in the rear where the mount 3 and tube 10 meet. Using welds to hold the tube 10 and baffle core 2 together is superior to the common method of threadedly secure an end cap 6 and mount 3 into the front and rear of a tube 10. The threads mandate that the tube wall thickness be at least 50% greater than is necessary for my method of assembly. The threads are also weaker than the full penetration, circumferential welds afforded by my method.

CONCLUSION, RAMIFICATION, AND SCOPE

Accordingly the reader will see that, according to the invention, I have provided a method for assembling a noise suppressor which will allow for a reduction in material wall thickness without compromising the strength and integrity of a noise suppressor. Further it can be seen that my method will allow for a noise suppressor to operate at higher pressures and temperatures due to the unique assembly method described. Also shown is a method of assembly which does not reply of threadedly securing a front end cap and mount to a tube in order to contain the noise suppressor's internals.

While my above drawings and description contain many specificities, these should not be construed as limitations on the scope of the invention, but rather as an exemplification of one preferred embodiment thereof. For example, my method is not limited to designs which us cone baffles, but rather can be incorporated into any noise suppressor design where the parts making up the internals have a similar out side diameter, and are produced from a wieldable material.

Accordingly, the scope of the invention should be determined not by the embodiments illustrated, but by the appended claims and their legal equivalents."

The invention claimed is:

1. A method of manufacturing a firearm sound suppressor, comprising the steps of:

providing a series of members comprising an end cap, at least one baffle having a forward side and a rearward side, at least one spacer adjacent the baffle, and a mount with means for attaching a sound suppressor to a firearm barrel, each of said members having peripheral edges substantially similar in shape and size;

positioning said members together such that the end cap provides a forward end, the mount provides a rearward end, and the at least one baffle and spacer are therebetween with peripheral edges substantially aligned and in substantial contact with the peripheral edge of an adjacent member;

securing each member to an adjacent member substantially continuously along the entire periphery thereof into a unified assembly by providing a full penetration, circumferential weld which fuses together the periphery of the baffle and both members adjacent the baffle in a single weld operation;

providing a tube sized and shaped to receive said assembly, said tube having a length and having first and second ends with edges, at least one of said edges being sized and shaped to contact a peripheral edge of at least one of said end cap and said mount;

securing said tube end edge circumferentially substantially along the entire peripheral contact thereof.

2. The method of claim 1, wherein the shape of said peripheral edges is circular.

3. The method of claim 1, wherein the tube is sized to closely receive said assembly in substantial contact with the assembly along substantially the entire length of said tube.

4. The method of claim 1, wherein the tube has a length such that its first end is secured to said mount and its second end is similarly secured to said end cap.

* * * * *